US007194849B2

(12) United States Patent
Komp

(10) Patent No.: US 7,194,849 B2
(45) Date of Patent: Mar. 27, 2007

(54) APPARATUS FOR OPENING BAGS LYING FLAT

(75) Inventor: Rainer Komp, Backnang (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/245,157

(22) Filed: Oct. 7, 2005

(65) Prior Publication Data

US 2006/0075725 A1 Apr. 13, 2006

(30) Foreign Application Priority Data

Oct. 7, 2004 (DE) ..... 10 2004 048 863

(51) Int. Cl.
*B65B 43/44* (2006.01)
*B65B 41/06* (2006.01)

(52) U.S. Cl. ..... 53/571; 53/386.1; 53/284.7

(58) Field of Classification Search ..... 53/284.7, 53/384.1, 386.1, 570, 571, 459, 460
See application file for complete search history.

(56) References Cited

U.S. PATENT DOCUMENTS 1,589,800 A * 6/1926 Frank ..... 53/571
3,050,918 A * 8/1962 Helm et al. ..... 53/386.1
3,381,446 A * 5/1968 Marchand ..... 53/386.1
3,688,471 A * 9/1972 Clark et al. ..... 53/571
3,884,278 A * 5/1975 Nakashima ..... 53/386.1
3,953,020 A * 4/1976 Ruf et al. ..... 53/571
3,961,461 A * 6/1976 Ruf et al. ..... 53/571
4,174,599 A 11/1979 Callet et al.
4,320,615 A * 3/1982 Gmur ..... 53/386.1
5,215,515 A 6/1993 Bershadsky
5,431,274 A 7/1995 Schaupp
5,564,252 A * 10/1996 Adelmann ..... 53/386.1
6,230,475 B1 * 5/2001 Savigny et al. ..... 53/571
6,880,310 B2 * 4/2005 Main et al. ..... 53/386.1
2004/0221551 A1 11/2004 Main et al.

FOREIGN PATENT DOCUMENTS

| | | |
|---|---|---|
| CA | 1092565 | 12/1980 |
| CH | 315224 | 7/1956 |
| FR | 2 590 231 A1 | 5/1987 |
| WO | WO 92/12900 A1 | 8/1992 |
| WO | WO 03/020615 A2 | 3/2003 |

* cited by examiner

*Primary Examiner*—Louis Huynh
(74) *Attorney, Agent, or Firm*—Ronald E. Greigg

(57) ABSTRACT

An apparatus for opening bags lying flat is part of a packaging system having a conveyor system, with receiving cups, located at equal intervals, for the bags. The bags are kept on hand in the form of blanks lying flat in bag magazines and are taken from the bags by means of a bag extracting device. By means of a gripper device, the blanks reach the region of suction plates, which open the blanks and insert them into the receiving cups. The apparatus according to the invention makes high capacity with a relatively simple construction possible.

12 Claims, 3 Drawing Sheets

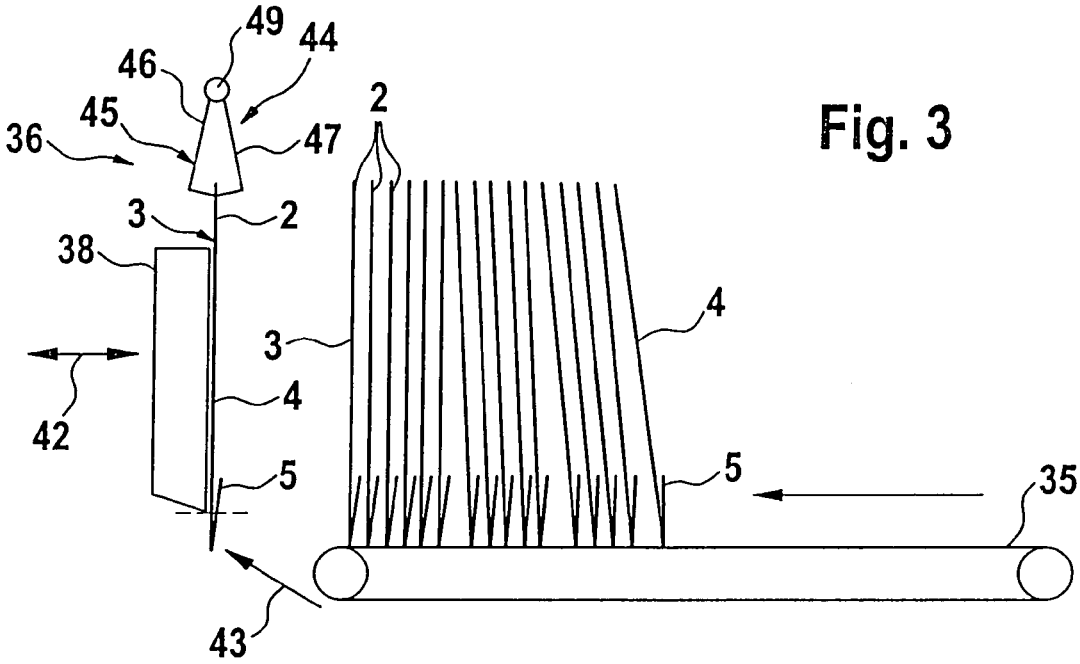
Fig. 3
Fig. 4
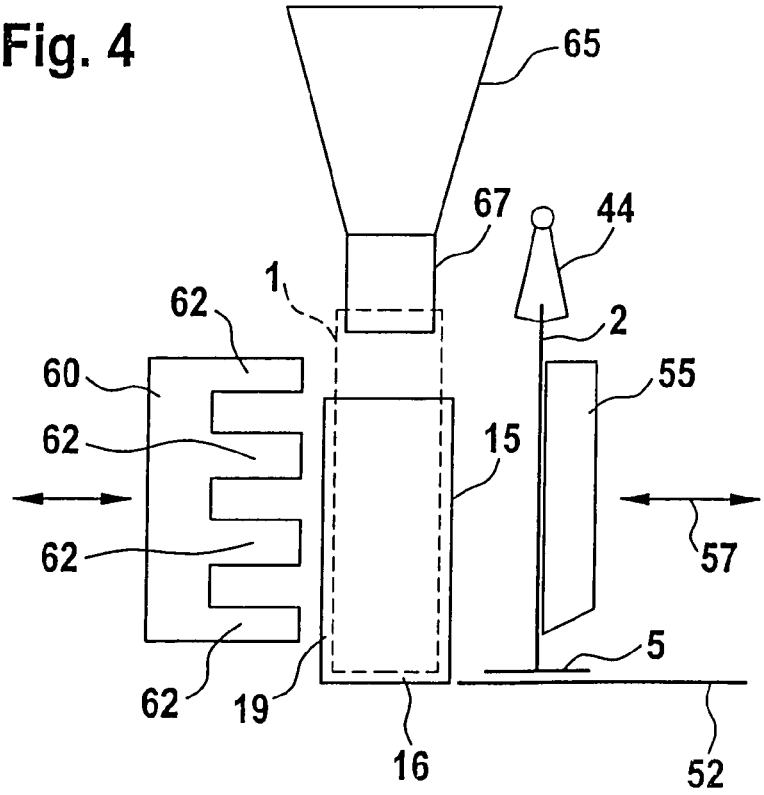

APPARATUS FOR OPENING BAGS LYING FLAT

BACKGROUND OF THE INVENTION

1. Field of the Invention

The invention relates to an improved apparatus for opening bags lying flat.

2. Description of the Prior Art

One apparatus of the type with which this invention is concerned is known from Swiss Patent CH 315224. In this known apparatus, one bag lying flat at a time is taken from a bag magazine by means of a suction arm, which is located linearly displaceably and pivotably in a shaft. The bag that is removed is transferred, after a pivoting motion of the arm, to a rotor that has four receiving places for bags. The rotor is rotatable in increments of 90° each in a vertically disposed shaft and firmly holds each bag during its entire conveying travel, or during the entire rotation of the rotor, by means of a gripper device. The grasping of each bag by the gripper device is made possible by two suction devices that engage diametrically opposed sides of the bag. A further suction device for opening the bag is provided in the region of a filling station that makes it possible to introduce a filling tube into the bag. The known apparatus, because of the high number of gripper devices, is relatively complicated in its construction. Moreover, the capacity of the known apparatus is limited by the fact that only one bag at a time can be dispensed to the rotor.

OBJECT AND SUMMARY OF THE INVENTION

The apparatus according to the invention for opening bags lying flat has the advantage that while having a relatively simple construction, it enables reliable operation at high capacity.

BRIEF DESCRIPTION OF THE DRAWINGS

The invention will be better understood and further objects and advantages thereof will become more apparent from the ensuing detailed description of a preferred embodiment taken in conjunction with the drawings, in which:

FIG. 3 is a section taken in the plane III—III of FIG. 2 in the region of a bag magazine; and FIG. 4 is a section through the system of FIG. 2 in the region of a bag insertion station.

DESCRIPTION OF THE PREFERRED EMBODIMENT

Figure 1:
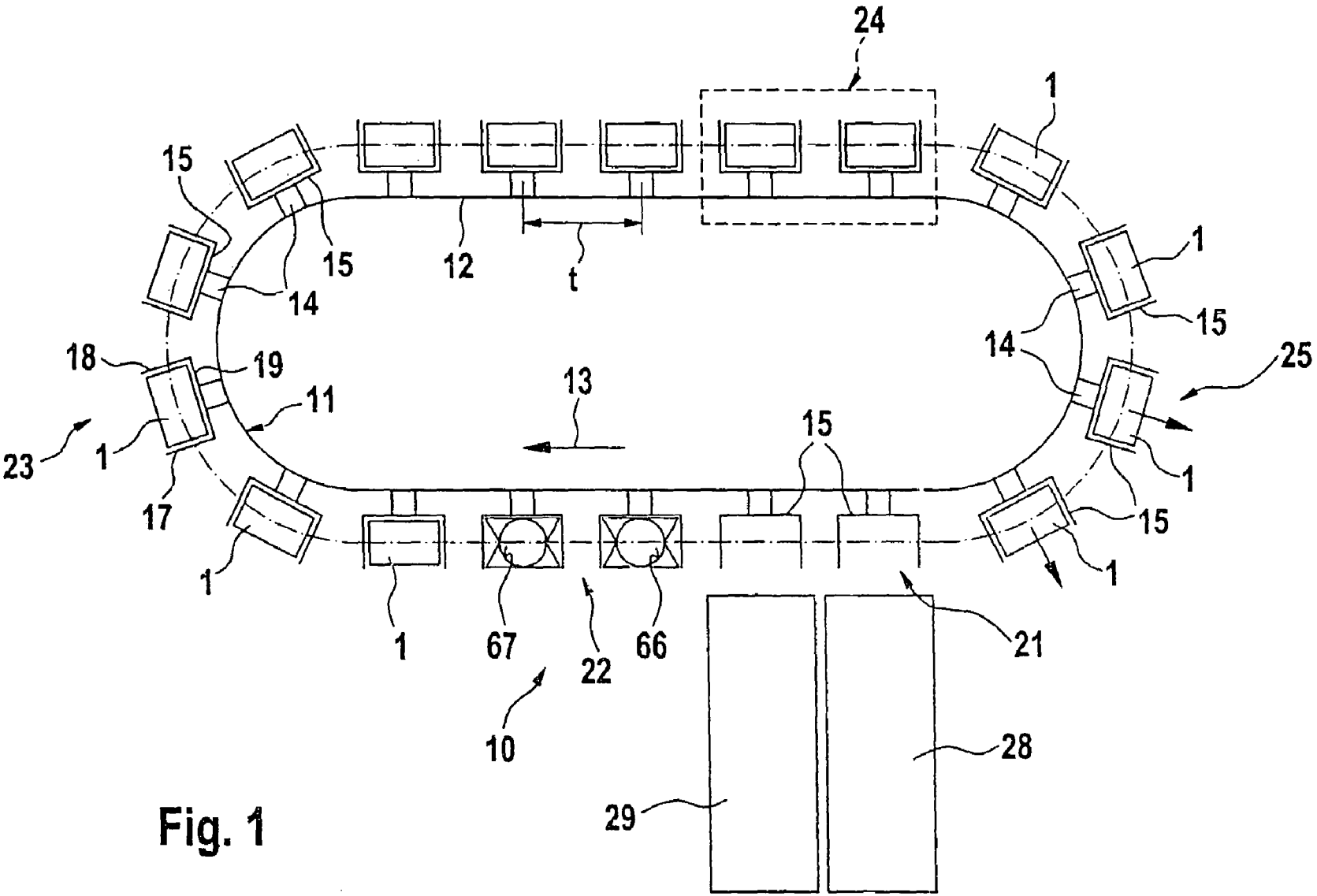
FIG. 1 is a simplified plan view of a packaging system embodying the invention.

The apparatus 10 shown in the drawings serves to open bags 1 lying flat, kept on hand in the form of blanks 2, and to insert these bags 1 into a conveyor system 11 of a packaging system. The conveyor system 11, designed as an oval rotor, has an endless conveying side 12. Receiving cups 15, adapted to the shape and size of bags 1, are secured replaceably to the conveying side 12 at equal intervals by means of carriers 14. The receiving cups 15 have a bottom 16, two side walls 17, 18, and one back wall 19. The side of the receiving cup 15 diametrically opposite the back wall 19 is open, so that in plan view (FIG. 1), receiving cups 15 that are open toward the outside are created.

The receiving cups 15 are advanced incrementally clockwise in the direction of the arrow 13 by means of a drive mechanism, not shown, via the conveying side 12; in the exemplary embodiment shown, the conveying increment corresponds to the spacing of two divisions t between two receiving cups 15. The conveyor path of the conveyor system 11 can be divided into a first region 21, in which the blanks 2 are furnished; a second region 22, in which the blanks 2 are inserted as bags 1 into the receiving cups 15 and the bags 1 are simultaneously filled with a product, in particular a pourable product; a third region 23, in which a product compression is done; a fourth region 24, in which closure devices, not shown, for closing the bags 1 are located; and a fifth region 25, in which the filled, closed bags 1 are removed from the receiving cups 15 of the conveyor system 11.

In the first region 21, extending rectilinearly, two bag magazines 28, 29 are located side by side as viewed in the conveying direction of the receiving cups 15. Each of the two bag magazines 28, 29, which are known per se and identical to one another, has lateral guides 30, 31 with retaining lugs 32, 33 for restraining the frontmost blank 2 in the bag magazine 28, 29. The blanks 2 are pressed or conveyed, each by means of one conveyor belt 34, 35 located in the region of the bottom of the bag magazines 28, 29, toward the retaining lugs 32, 33, so that a blank 2 is always ready there. The bag magazines 28, 29 are preferably filled manually; that is, as the fill level drops, additional blanks 2 are introduced by hand into the bag magazine 28, 29 between the guides 30, 31, from the side diametrically opposite the retaining lugs 32, 33.

A bag extracting device 36 is located on the conveyor system 11 between the bag magazines 28, 29 and the receiving cups 15. The bag extracting device 36 includes two coupled-together suction plates 37, 38, which are movable perpendicular to the conveying direction of the receiving cups 15, or in other words parallel to the orientation of the bag magazines 28, 29, as indicated by the double arrows 41, 42. Each of the identically embodied suction plates 37, 38 is brought into coincidence with the wall 3, oriented toward it, of a blank 2 and is movable between a withdrawal position and a transfer position. In the withdrawal position, the suction plates 37, 38, are each in contact with one of the blanks 2 in the associated bag magazine 28, 29. Via a vacuum source, not shown, an underpressure is applied to the respective wall 3 of the blank 2, and this underpressure, upon movement of the suction plates 37, 38 into the transfer position that is spaced apart from the bag magazines 28, 29, causes the applicable blank 2 to overcome the resistance of the retaining lugs 32, 33 so that it can be pulled out of the bag magazine 28, 29.

Upon the transfer of the blanks 2 from the bag magazines 28, 29 to the transfer position shown in FIG. 3, the bottom 5, placed flat against the wall 4 of the blank 2 and folded, is repositioned to the horizontal, which is meant to be represented by the arrow 43 in FIG. 3, by means of a bottom repositioning slide, not shown.

A gripper device 44 is located above the bag extracting device 36, in the region of the transfer position of the suction plates 37, 38. For each blank 2, the gripper device 44 has one gripper 45, which are coupled to one another and each assigned to one of the suction plates 37, 38. As shown in FIG. 3, the gripper 45 has two openable and closable prongs 46, 47, which are pivotable about a common shaft 49. The gripper device 44 and its grippers are movable back and forth between the first region 21 and the second region 22, that is, parallel to the conveyor path of the receiving cups 15, in the direction indicated by the double arrow 51.

In the second region 22, a slide plate 52 (FIG. 2) is located next to the conveyor path of the receiving cups 15, at the level of the bottom 16 of the receiving cups 15. Two further suction plates 54, 55, coupled together, are also provided, aligned with the wall 4 of the blanks 2, and are movable as indicated by the double arrows 56, 57.

Figure 2:
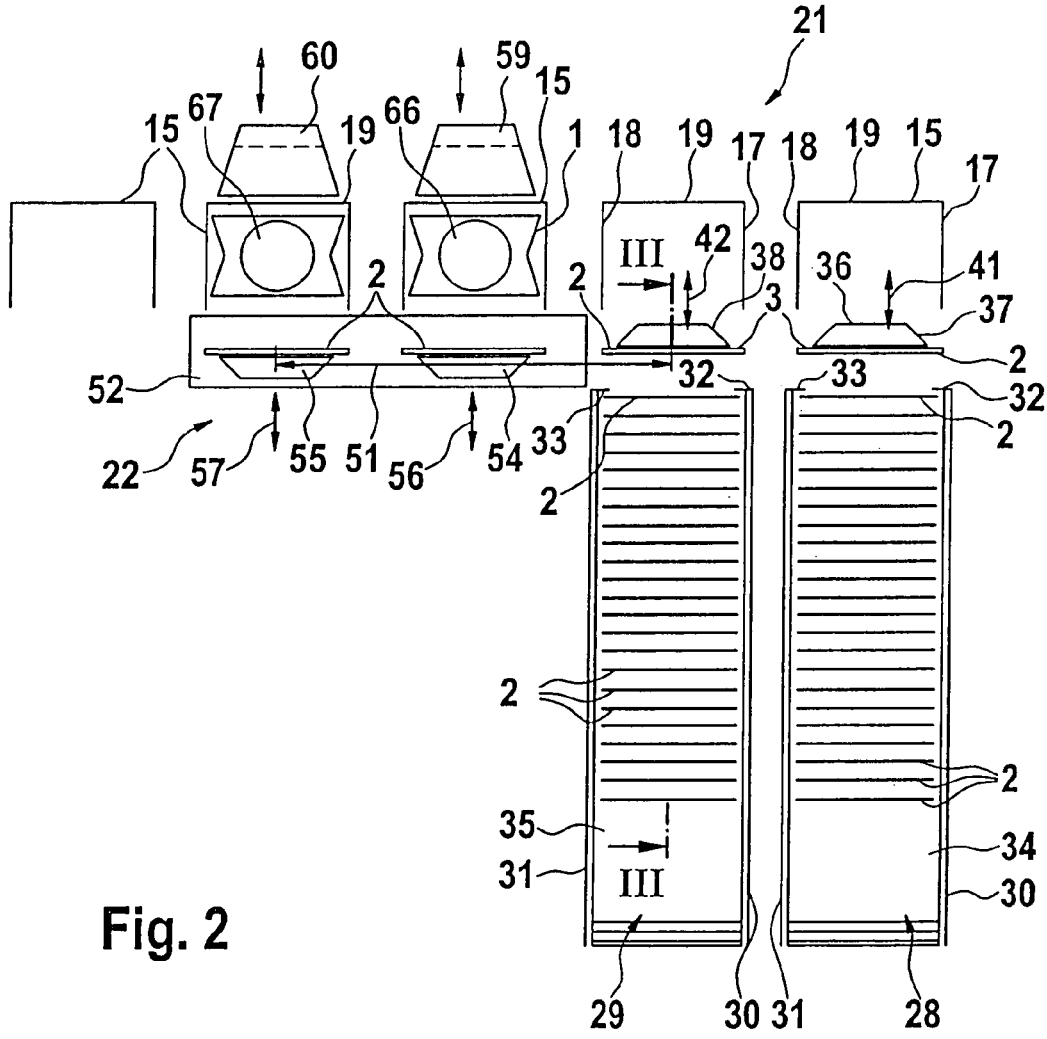
FIG. 2 is a plan view of the packaging system of FIG. 1 in the region of the bag delivery.

On the side of the back walls 19 of the receiving cups 15, facing away from the slide plate 52, two suction plates 59, 60, embodied in comblike fashion and coupled together and visible in FIGS. 2 and 4, are provided, which cooperate with the two suction plates 54, 55 and are aligned centrally with the receiving cups 15, when the receiving cups are in a stopped position in the second region. The two slight protrusions 62 of the suction plates 59, 60 are located in coincidence with recesses, not identified by reference numerals, in the back walls 19 of the receiving cups 15, so that upon a motion of the suction plates 59, 60 in the direction of the slide plate 52, the protrusions 62 can penetrate through the recesses of the receiving cups 15. Also provided in the second region 22, above the conveyor system 11, is a filling device 65, with two metering tubes 66, 67 that can be introduced into the opening cross section of the opened bags 1 (represented by dot-dashed lines in FIG. 4) and are optionally pivotable in the conveying direction 51 of the bags, in order to lengthen the filling time.

The apparatus 10 described thus far functions as follows: By means of the suction plates 37, 38 of the bag extracting device 36, one blank 22 is pulled simultaneously out of each of the bag magazines 28, 29. The blanks 2 are transferred, in the transfer position (FIG. 3), to the grippers 45 of the gripper device 44, and after that, the underpressure at the suction plates 37, 38 is switched off. Next, the grippers 45 are moved into the position that is aligned with the suction plates 54, 55. The suction plates 54, 55 are then put into contact with the blanks 2, and an underpressure for holding the blanks 2 is generated. Now the prongs 46, 47 of the grippers 45 can be opened and returned to their original position for taking over the blanks 2 that follow. The suction plates 54, 55 are now moved into the receiving cups 15, while simultaneously, through the receiving cups 15, the suction plates 59, 60 are put into contact with the walls 3 facing them of the blanks 2. By a controlled motion that spreads the respective cooperating suction plates 54, 59 and 55, 60 apart from one another, these plates act as opening devices for the blanks 2, so that the metering tubes 66, 67 inside the receiving cups 15 plunge into the opening cross sections of the bags 1, and filling can begin. As soon as the metering tubes 66, 67 are located inside the bag openings, the underpressure at the suction plates 54, 55, 59, 60 can be shut off. Finally, the suction plates 54, 55, 59, 60 are moved back into their original position, whereupon the procedures are repeated as described. It is understood that the drive of the conveyor system 11 must be adapted, particularly to the suction plates 54, 55, 59, 60, such that the introduction of the blanks 2 into the receiving cups 15 is always done while the conveyor system 11 is stopped.

The apparatus 10 described thus far may be modified or altered in manifold ways. Particularly for adapting the capacity, a different number of bag magazines 28, 29 is conceivable, along with suitably adapted bag extracting devices 36, gripper devices 44, and suction plates. The conveyor system 11 may also be embodied in a straight line, for instance.

The foregoing relates to a preferred exemplary embodiment of the invention, it being understood that other variants and embodiments thereof are possible within the spirit and scope of the invention, the latter being defined by the appended claims.

I claim:

1. An apparatus for opening bags lying flat, the apparatus comprising at least one bag magazine for receiving bags kept on hand in the form of blanks lying flat;

a bag extracting device that has suction devices for extracting the bag that is frontmost in the bag magazine;

a gripper device for grasping the bag in the region of its top, for taking over the bag from the bag extracting device;

an opening device having suction devices for opening the blank lying flat into a bag for a filling device that plunges into an opening in the bag, a conveyor system movable along a conveyor path past the at least one bag magazine, the extracting device, the gripper device, and the opening device, the gripper device being movable, parallel to and spaced apart from the conveyor path between a takeover position in the region of the bag magazine and a transfer position to the opening device spaced apart from the bag magazine along the conveyor path;

for each bag, the opening device having one retaining device, which has two suction devices, and which acts from diametrically opposite sides each on a respective side wall of the bag; and the suction devices, associated with one bag being movable transversely to the conveyor path of the conveyor system between a position for takeover of the bag from the gripper device and a position for transferring the bag to a receptacle of the conveyor system.

2. The apparatus as recited in claim 1, wherein the conveyor system comprises an endlessly revolving conveying side, with receptacles at equal intervals; and wherein the receptacles are embodied in cuplike fashion, with the receptacles being open on the side toward the gripper device.

3. The apparatus as recited in claim 2, wherein a backwall of the receptacle is located in coincidence with the two side walls of the bag, the back wall having at least one recess; wherein the suction devices, associated with one bag, of the opening device are located on diametrically opposite sides of the conveyor system; and wherein one of the suction devices, for retaining the bag, can be passed through the recess onward to the bag.

4. The apparatus as recited in claim 3, wherein a plurality of bag magazines are provided, which are located parallel to one another beside the conveyor path of the conveyor system in the conveying direction; wherein a number of suction devices, corresponding to the number of bag magazines, is provided on the bag extracting device and the opening device; and wherein the suction devices are each coupled with one another and are movable jointly on the bag extracting device and the opening device.

5. The apparatus as recited in claim 4, wherein the filling device is located in the region in which the bags are inserted into the receptacles of the conveyor system; and wherein the filling device, for each bag, has one metering tube that can be lowered into an opening cross section of the bag.

6. The apparatus as recited in claim 3, wherein the filling device is located in the region in which the bags are inserted into the receptacles of the conveyor system; and wherein the filling device, for each bag, has one metering tube that can be lowered into an opening cross section of the bag.

7. The apparatus as recited in claim 2, wherein a plurality of bag magazines are provided, which are located parallel to one another beside the conveyor path of the conveyor system in the conveying direction; wherein a number of suction devices, corresponding to the number of bag magazines, is provided on the bag extracting device and the opening device; and wherein the suction devices are each coupled with one another and are movable jointly on the bag extracting device and the opening device.

8. The apparatus as recited in claim 7, wherein the filling device is located in the region in which the bags are inserted into the receptacles of the conveyor system; and wherein the filling device, for each bag, has one metering tube that can be lowered into an opening cross section of the bag.

9. The apparatus as recited in claim 2, wherein the filling device is located in the region in which the bags are inserted into the receptacles of the conveyor system; and wherein the filling device, for each bag, has one metering tube that can be lowered into an opening cross section of the bag.

10. The apparatus as recited in claim 1, wherein a plurality of bag magazines are provided, which are located parallel to one another beside the conveyor path of the conveyor system in the conveying direction; wherein a number of suction devices, corresponding to the number of bag magazines, is provided on the bag extracting device and the opening device; and wherein the suction devices are each coupled with one another and are movable jointly on the bag extracting device and the opening device.

11. The apparatus as recited in claim 10, wherein the filling device is located in the region in which the bags are inserted into the receptacles of the conveyor system; and wherein the filling device, for each bag, has one metering tube that can be lowered into an opening cross section of the bag.

12. The apparatus as recited in claim 1, wherein the filling device is located in the region in which the bags are inserted into the receptacles of the conveyor system; and wherein the filling device, for each bag, has one metering tube that can be lowered into an opening cross section of the bag.

* * * * *